US007100848B2

(12) United States Patent
Kobayashi et al.

(10) Patent No.: US 7,100,848 B2
(45) **Date of Patent: *Sep. 5, 2006**

(54) FUEL INJECTION VALVE

(75) Inventors: Nobuaki Kobayashi, Gunma (JP); Nobutaka Ishii, Gunma (JP); Tomoichi Misawa, Gunma (JP); Hideo Kato, Tochigi (JP)

(73) Assignee: Hitachi, Ltd., Tokyo-to (JP)

( * ) Notice: Subject to any disclaimer, the term of this patent is extended or adjusted under 35 U.S.C. 154(b) by 294 days.

This patent is subject to a terminal disclaimer.

(21) Appl. No.: 10/434,149

(22) Filed: May 9, 2003

(65) Prior Publication Data

US 2003/0222159 A1 Dec. 4, 2003

(30) Foreign Application Priority Data

May 30, 2002 (JP) ..... 2002-157919
Jan. 31, 2003 (JP) ..... 2003-023128

(51) Int. Cl.
*B05B 1/00* (2006.01)
*B05B 1/30* (2006.01)

(52) U.S. Cl. ..... 239/596; 239/537.12; 239/585.1; 239/585.4; 239/556; 239/558; 239/900; 239/598; 239/533.2

(58) Field of Classification Search ..... 239/533.12, 239/533.2, 556, 557, 553.3, 558, 585.2, 585.4, 239/585.1, 585.5, 900, 601, 596
See application file for complete search history.

(56) References Cited

U.S. PATENT DOCUMENTS 4,699,323 A * 10/1987 Rush et al. ..... 239/544
5,540,200 A * 7/1996 Naitoh et al. ..... 123/299
6,089,476 A * 7/2000 Sugimoto et al. ..... 239/596
6,186,418 B1 * 2/2001 Tani ..... 239/533.2
6,783,087 B1 * 8/2004 Aoki et al. ..... 239/596
6,814,312 B1 * 11/2004 Iwano et al. ..... 239/585.1

FOREIGN PATENT DOCUMENTS

JP 62-261664 A 11/1987
JP 2001-27169 A 1/2001

* cited by examiner

*Primary Examiner*—Dinh Q. Nguyen
(74) *Attorney, Agent, or Firm*—Sughrue Mion, PLLC

(57) ABSTRACT

A fuel injection valve of an internal combustion engine for a vehicle is comprised of a nozzle plate which has a plurality of nozzle holes. Fuel injection jets are injected from the nozzle holes and collided with each other. The thickness of the nozzle plate is equal to or greater than the diameter of the nozzle holes.

16 Claims, 9 Drawing Sheets

FUEL INJECTION VALVE

BACKGROUND OF THE INVENTION

The present invention relates to a fuel injection valve which is preferably employed as a fuel injection valve of an internal combustion engine for a vehicle.

Japanese Patent Provisional Publication 2001-27169 discloses a fuel injection valve. Nozzle plates of this sort of injection valve according to the related art can be divided into two groups. One group is colliding nozzle plates, wherein nozzle holes formed in the nozzle plate are inclined so as to collide jets of fuel ejected from the nozzle holes. Another group is non-colliding nozzle plates, wherein the nozzle holes are inclined so that fuel jets ejected therefrom are not-mutually collided.

In an instance of a non-colliding nozzle plate, an injection jet of fuel can be discharged in a wide area to promote atomization of fuel by setting the thickness of the nozzle plate smaller than the diameter of the nozzle holes.

SUMMARY OF THE INVENTION

However, in an instance of a colliding nozzle plate, if the thickness of the nozzle plate is set smaller than the diameter of the nozzle holes, the shorter the length of the nozzle holes becomes, the less the injection jets of fuel from each nozzle tend to travel in a straight line. Thus, the jets from each nozzle hole do not properly collide, and it is difficult to promote atomization of the fuel.

It is therefore an object of the present invention to provide a fuel injection valve which is capable of promoting atomization of injected fuel from a colliding nozzle plate.

An aspect of the present invention resides in a fuel injection valve comprising a casing comprising a fuel passage, a valve seat member disposed in the casing, the valve seat member comprising a valve seat, a valve element displaceably disposed within the casing, normally resting on the valve seat, and a nozzle plate covering the valve seat, the nozzle plate comprising a plurality of nozzle-hole sets, each of which comprises a plurality of nozzle holes, each nozzle-hole set injecting fuel injection jets and colliding the fuel injection jets with each other when the valve element is lifted from the valve seat, a thickness of the nozzle plate being equal to or greater than a diameter of the nozzle holes.

Another aspect of the present invention resides in a fuel injection valve connected to an internal combustion engine, the fuel injection valve comprising a casing comprising a fuel passage, a valve seat member disposed in the casing, the valve seat member comprising a valve seat, a valve element displaceably disposed within the casing; and a nozzle plate covering the valve seat, the nozzle pate comprising six nozzle-hole sets, each nozzle-hole set comprising two nozzle holes, each nozzle-hole set injecting two fuel injection jets and colliding the two fuel injection jets with each other when the valve element is lifted from the valve seat, the nozzle-hole sets constituting two nozzle-hole-set aggregations, the nozzle-hole-set aggregations being arranged to direct the collided fuel injection jets to two different directions, a ratio between the thickness of the nozzle plate and the diameter of the nozzle holes being equal to or greater than a value of 1.0.

A further aspect of the present invention resides in a fuel injection valve, comprising a casing defining a fuel passage, a valve seat member disposed in the casing, the valve seat member defining a valve seat, a valve element displaceably disposed in the casing, and a nozzle plate covering the valve seat, the nozzle plate comprising a plurality of nozzle-hole-set aggregations which are symmetrically arranged with respect to a center line of the nozzle plate, each of the nozzle-hole-set aggregations comprising a plurality of nozzle-hole sets, each of the nozzle-hole sets comprising a plurality of nozzle holes, each nozzle-hole set injecting fuel injection jets and colliding the fuel injection jets with each other when the valve element is displaced so as to form a clearance between the valve element and the valve seat, each nozzle-hole set forming a spray pattern in the direction away from the center line of the nozzle plate, a thickness t of the nozzle plate and a diameter d of the nozzle holes existing in a ratio where the equation $t/d \geqq 1.0$ is satisfied.

The other objects and features of this invention will become understood from the following description with reference to the accompanying drawings.

DETAILED DESCRIPTION OF THE INVENTION

Figure 1:
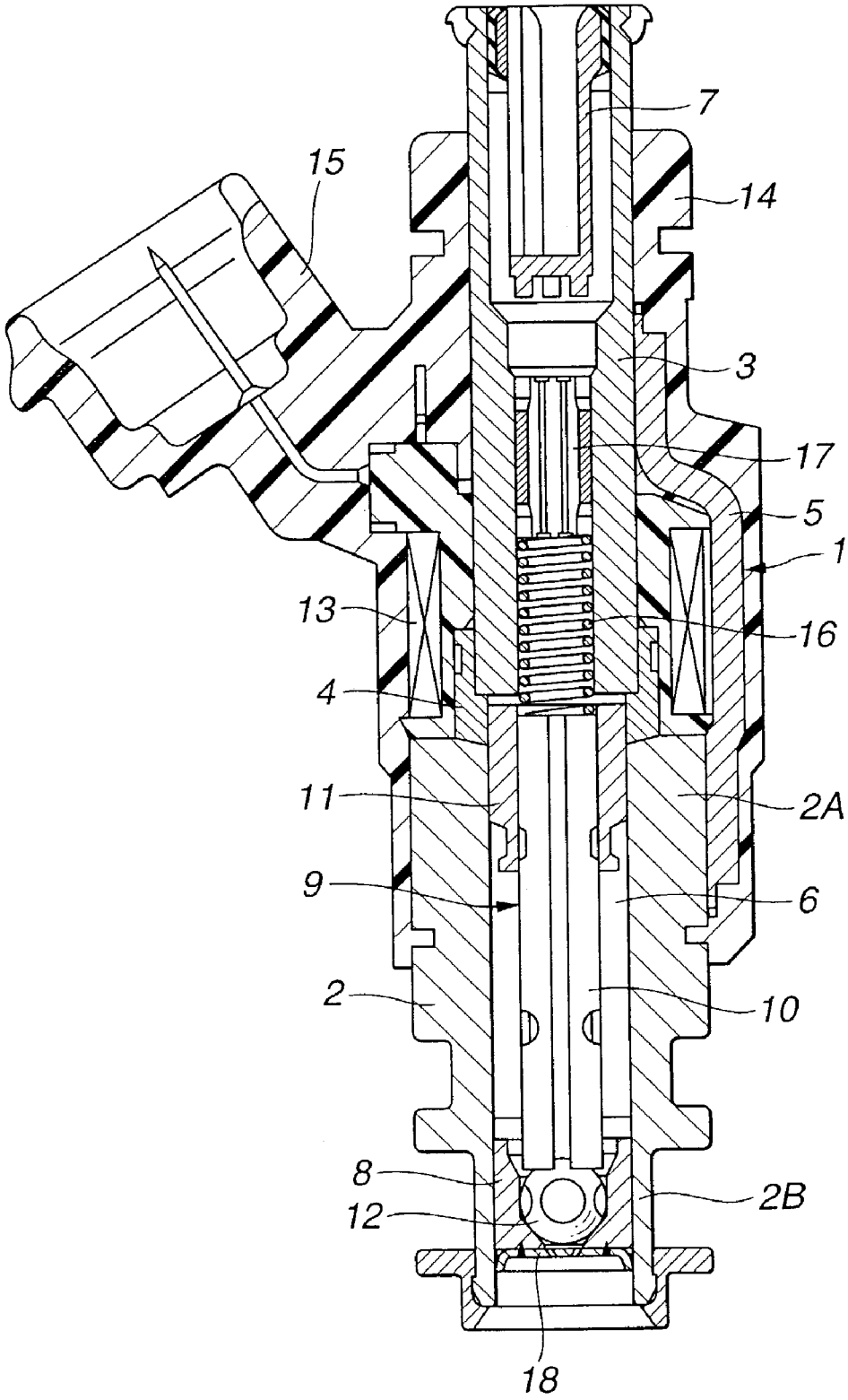
FIG. 1 is a cross-sectional view showing a fuel injection valve according to a first embodiment of the present invention.

Referring to FIGS. 1 through 8, there is discussed a first embodiment of a fuel injection valve applied to an internal combustion engine for a vehicle in accordance with the present invention.

A casing 1, which is substantially tubular, constitutes a main body portion of a fuel injection valve. Casing 1 comprises a valve casing 2, a fuel inlet pipe 3, and a magnetic-path forming member 5.

Valve casing 2, which is step-shaped, is disposed at an end of casing 1, and is made of a magnetic material such as electromagnetic stainless steel. Valve casing 2 comprises a large-diameter tube portion 2A and a small-diameter tube portion 2B which is formed integrally with large-diameter tube portion 2A at an end thereof. A resin cover 14 is attached to a base of large-diameter portion 2A.

Fuel inlet pipe 3 is formed as a tube from magnetic material such as electromagnetic stainless steel, and is joined to a base of valve casing 2 by a tubular joining member 4 made of non-magnetic material. Fuel inlet pipe 3 is magnetically connected with valve casing 2 by magnetic-path forming member 5. Magnetic-path forming member 5 is a narrow piece of magnetic metal disposed on an outer circumference of an electromagnetic coil 13.

Thus, when electromagnetic coil 13 is electrically energized, it is possible to form a closed magnetic circuit with valve casing 2, fuel inlet pipe 3, magnetic-path forming member 5, and an attraction portion 11 of a valve element 9. A fuel passage 6 which extends axially from the base of fuel inlet pipe 3 as far as a valve seat member 8 within valve casing 2, and a fuel filter 7 to filter fuel supplied to fuel passage 6 are disposed within casing 1.

A valve seat member 8 is inserted within small diameter tube portion 2B of valve casing 2. Valve seat member 8 is formed from metallic or plastic material, and is tubular as can be seen from FIG. 2. A valve element insertion hole 8A is defined in an inner circumference at the base of valve seat member 8. A substantially conic valve seat 8B is formed at an end of valve element insertion hole 8A, and defines a circular injection opening 8C.

Valve element 9 is displaceably disposed within valve casing 2, and comprises a valve shaft 10 formed by bending a material such as metal plate into a tube-shape, attraction portion 11 which is formed into a tubular shape from a magnetic or similar material and fixed to the base of valve shaft 10, and a valve portion 12 which is spherical and rests on and lifts from valve seat 8B of valve seat portion 8. A plurality of depression portions 12A are formed on the outer circumference of valve portion 12 to form spaces between valve portion 12 and the inner circumference of valve seat member 8 as shown in FIGS. 1 and 2.

When valve element 9 closes to prevent flow of fuel, valve portion 12 is held in a rested state upon valve seat 8B of valve seat member 8 due to a spring force of valve spring 16, and in this state, attraction portion 11 and fuel inlet pipe 3 are separated by a space along a common axis. When electromagnetic coil 13 is electrically energized, a magnetic field is generated by electromagnetic coil 13, and attraction portion 11 of valve element 9 is magnetically attracted by fuel inlet pipe 3. Valve element 9 displaces axially against the spring force of valve spring 16, and valve portion 12 lifts from valve seat 8B, resulting in the valve opening.

Figure 2:
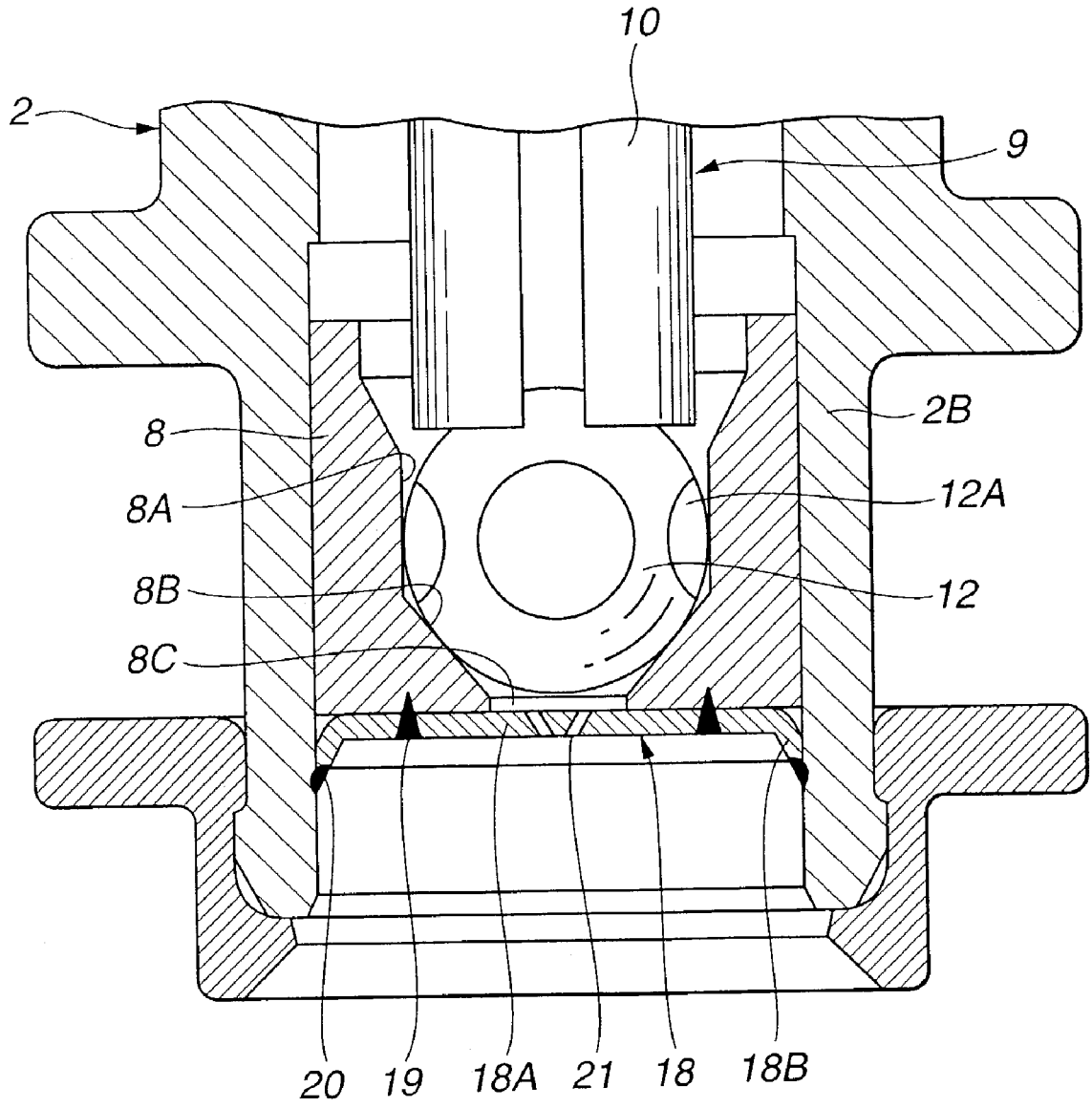
FIG. 2 is an enlarged cross-sectional view of an end of a valve casing in FIG. 1.

Electromagnetic coil 13 is disposed on an outer circumference of fuel inlet pipe 3 as an actuator, and is covered by resin cover 14, which is fixed from valve casing 2 to fuel inlet pipe 3 as shown in FIG. 1. A magnetic field is generated by energizing electromagnetic coil 13 through a connector 15 disposed on resin cover 14, and valve element 9 is made to open.

Valve spring 16 is located within fuel inlet pipe 3 in a compressed form. Valve spring 16 is disposed between valve element 9 and a tubular element 17 which is fixed within fuel inlet pipe 3, and applies force to valve element 9 in the direction of valve seat member 8 to hold the valve in a closed position. When valve element 9 opens against the spring force of valve spring 16, fuel inside fuel passage 6 is divergently injected left and right from nozzle plate 18 into an intake manifold or similar area.

Figure 3:
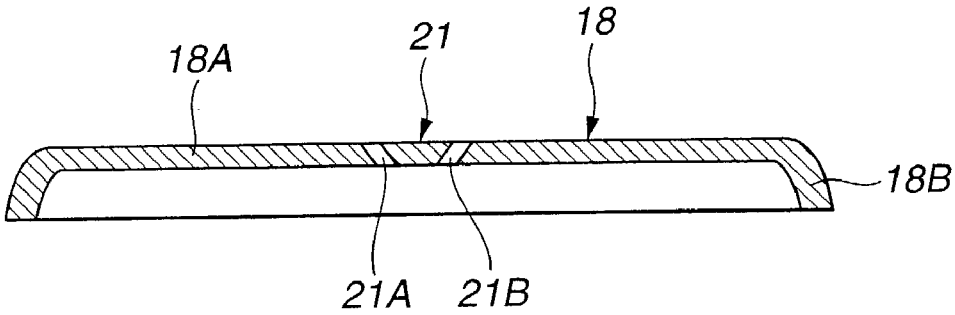
FIG. 3 is a cross-sectional view showing only a nozzle plate found in FIG. 2.
Figure 4:
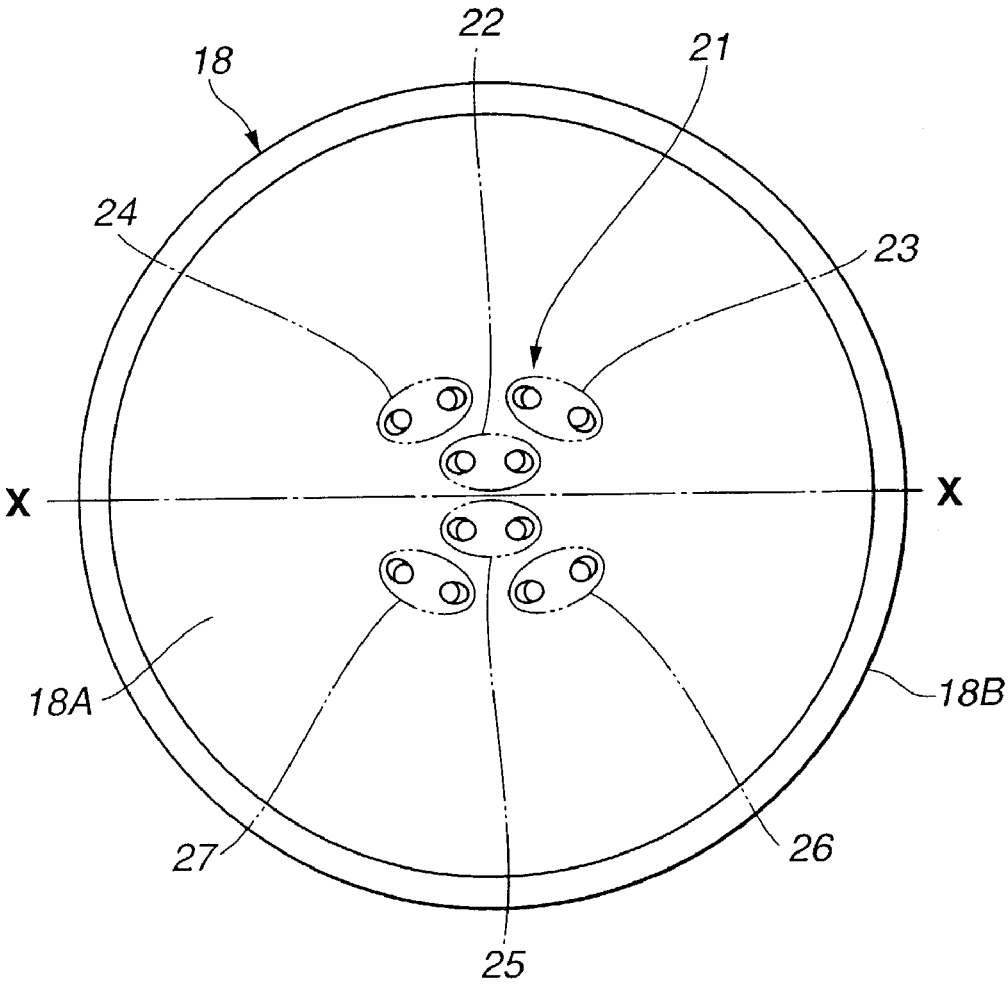
FIG. 4 is a top view showing only the nozzle plate of FIG. 3.

Nozzle plate 18 covers injection opening 8C of valve seat member 8 on an outer side injection opening 8C. As shown in FIGS. 2 through 4, nozzle plate 18 comprises a flat portion 18A formed as a circular plate, which could be achieved through the pressing of metal plate, and a rim portion 18B which is formed in a substantial L-shape on an outer circumference of flat portion 18A.

Flat portion 18A is joined to an end of valve seat portion 8 by a welding portion 19, and rim portion 18B is joined to an inner circumference of small diameter tube portion 2B of valve casing 2 by a welding portion 20.

Figure 5:
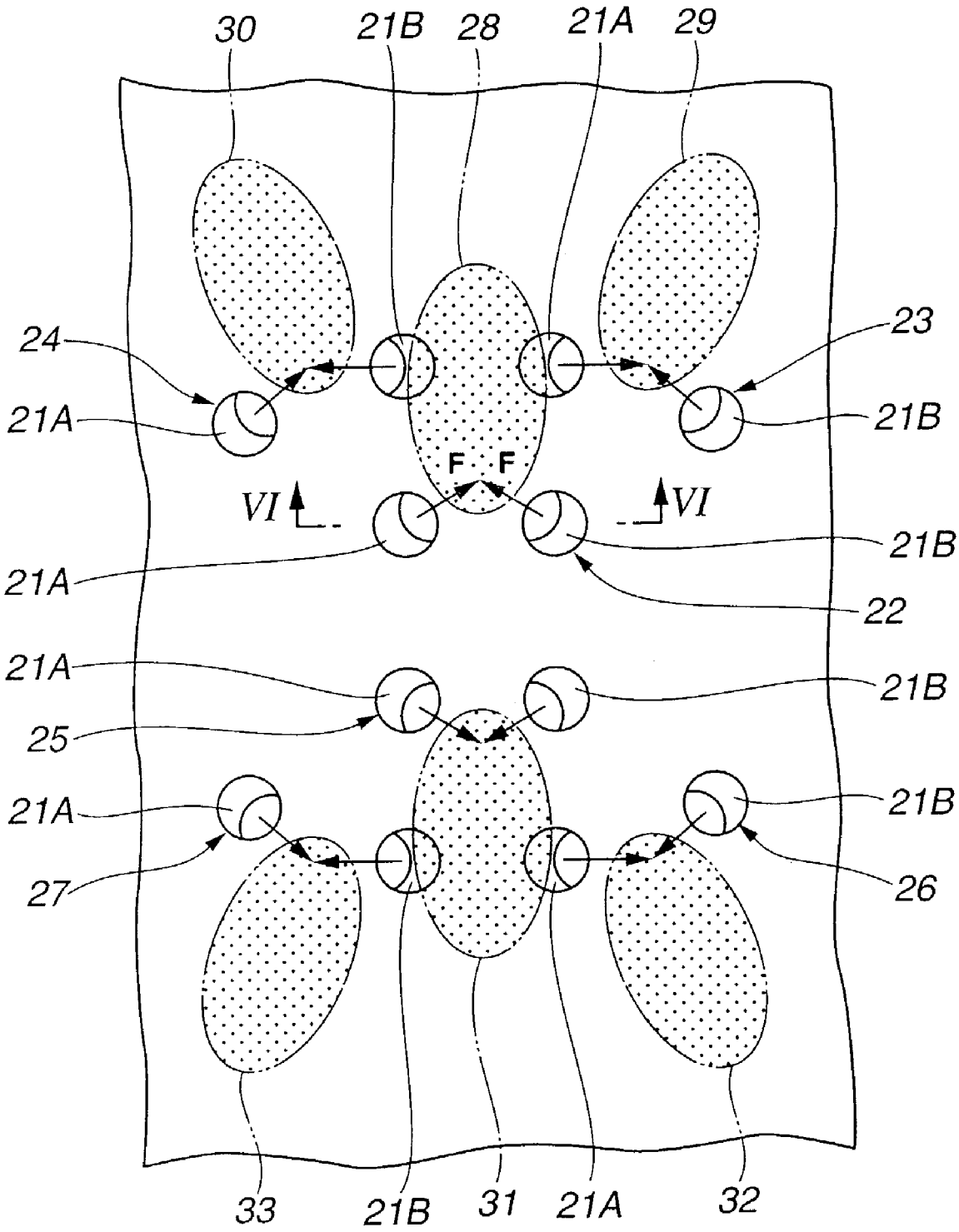
FIG. 5 is an enlarged view showing nozzle-hole sets found in FIG. 4 enlarged together during an injection operation.

A plurality of nozzle holes 21 is disposed on flat portion 18A of nozzle plate 18. Referring to FIGS. 4 and 5, a total of 12 holes are formed in a center area of flat portion 18A, and fuel inside casing 1 is ejected from each nozzle hole when valve element 9 opens.

Each nozzle hole 21 comprises two adjacent nozzle holes 21A and 21B to constitute a nozzle-hole set 22, 23, 24, 25, 26, 27, there being six nozzle-hole sets. An axis X—X runs through nozzle plate 18 to divide nozzle plate 18 into two symmetrical halves, and divides the nozzle-hole sets into two groups of three sets each, with nozzle-hole sets 22, 23 and 24 on one side and nozzle-hole sets 25, 26 and 27 disposed symmetrically thereto on the other side.

Figure 6:
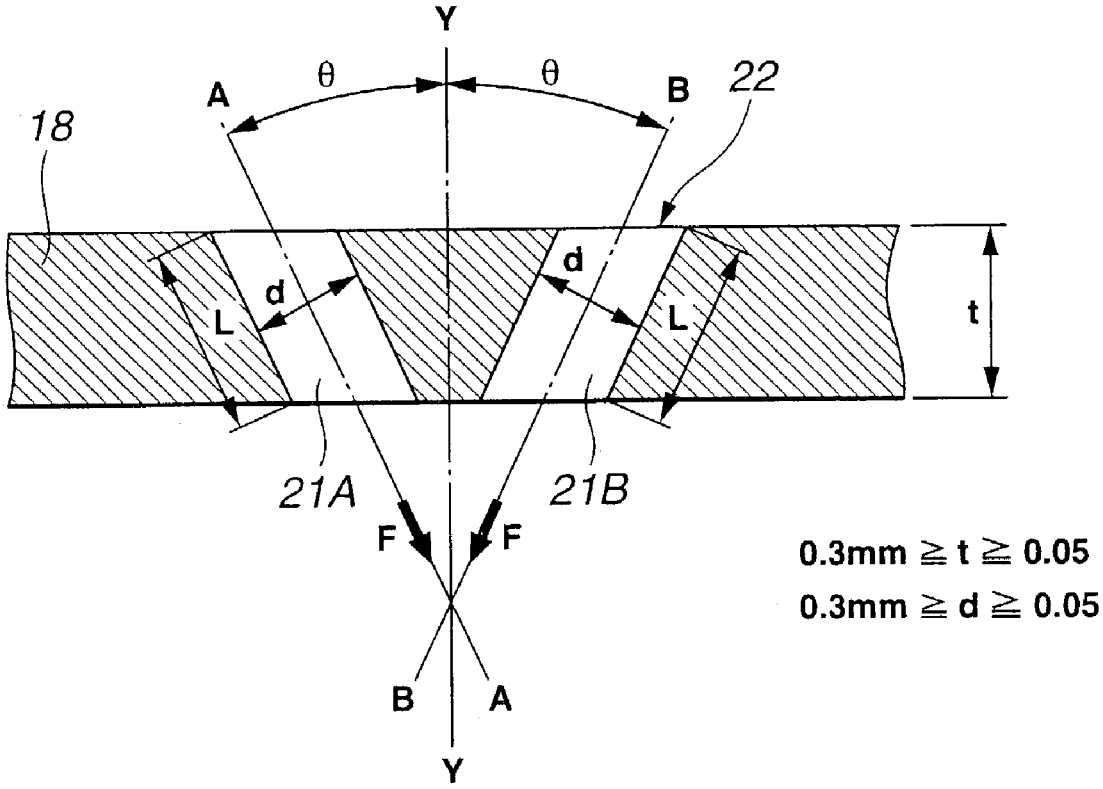
FIG. 6 is an enlarged cross-sectional view showing a pair of nozzle holes constituting a nozzle-hole set, in the direction of the arrows VI—VI found in FIG. 5.

As shown in FIG. 6, respective hole centers A—A and B—B of nozzle holes 21A and 21B constituting each nozzle-hole set 22 through 27 are inclined by an angle θ with respect to an axis Y—Y which is orthogonal to flat portion 18A of nozzle plate 18. Hole centers A—A and B—B intersect to form a V-shape centered about axis Y—Y.

Thus, each nozzle set 22 through 27 is formed as a colliding nozzle-hole set which collides injection jets of fuel injected from respective nozzle holes 21A and 21B in the directions designated by F.

Nozzle-hole sets 22 through 27 atomize fuel by colliding injection jets of fuel discharged from nozzle holes 21A and 21B into each other, and discharge fuel in the spray patterns 28, 29, 30, 31, 32, and 33 shown in FIG. 5.

A plate thickness t of nozzle plate 18 (flat portion 18A) and a hole diameter d of nozzle holes 21A and 21B exist in a dimensional ratio t/d where the following expression (1) is satisfied.

$$t/d \geqq 1.0 \quad (1)$$

According to this first embodiment, plate thickness t of nozzle plate 18 is set within a range 0.3 mm≧t≧0.05 mm, and hole diameter d of each nozzle hole 21A, 21B is set within a range 0.3 mm≧d≧0.05 mm as can be seen in FIG. 6.

Thus, it is possible to set a length L of nozzle holes 21A and 21B formed in nozzle plate 18 to be long, and to maintain the ability of injection jets to travel in a straight line when the injection jets are discharged from respective nozzle holes 21A and 21B in the directions designated by F.

This helps to ensure injection jets discharged from nozzle holes 21A and 21B of each nozzle-hole set 22 through 27 are properly collided, making it possible to promote atomization of fuel, and broaden spray patterns 28 through 33 from nozzle-hole sets 22 through 27 into a wider area.

The operation of the fuel injection valve according to this first embodiment will hereinafter be explained.

First, a magnetic field is formed by elements including valve casing 2, fuel inlet pipe 3, and magnetic-path forming member 5 when electrical power is fed to electromagnetic coil 13 through connector 15, and attraction portion 11 of valve element 9 is magnetically attracted to an end surface of fuel inlet pipe 3.

As a result, valve portion 12 of valve element 9 lifts from valve seat 8B of valve seat member 8, and valve element 9 opens against the force of valve spring 16. Fuel within fuel passage 6 is discharged from injection opening 8C of valve seat member 8 through each nozzle-hole set 22, 23, 24, 25, 26, 27 of nozzle plate 18.

In this instance as shown by FIG. 6, injection jets of fuel ejected from each nozzle hole 21A, 21B of nozzle-hole set 22 in the directions designated by F collide with each other. Referring to FIG. 5, fuel which is atomized by the collision of the injection jets is discharged from nozzle-hole set 22 in spray pattern 28.

Fuel is discharged in the same manner from other nozzle-hole sets 23, 24, 25, 26, and 27 and atomized in spray patterns 29, 30, 31, 32, and 33, so that fuel discharged from each nozzle-hole set 22 through 27 is supplied to an engine intake manifold in a properly intermixed condition (not shown).

Figure 7:
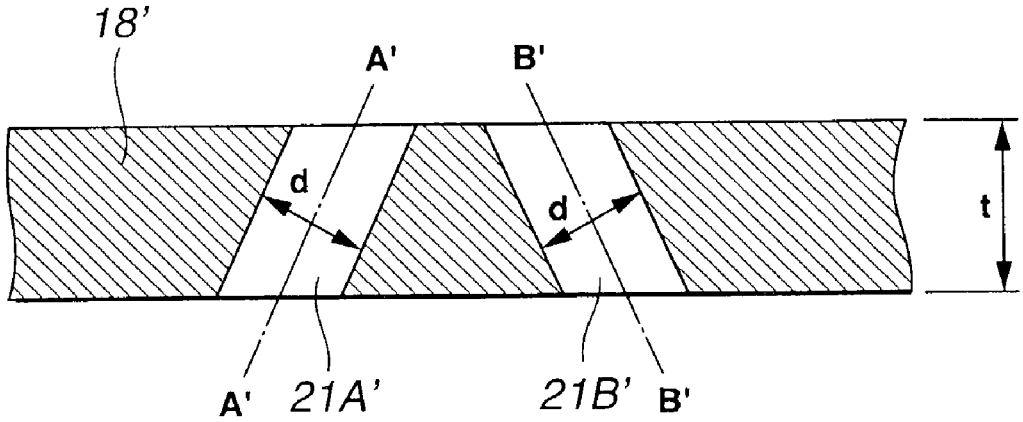
FIG. 7 is an enlarged cross-sectional view showing a non-colliding nozzle plate and constituent nozzle holes in the same manner as in FIG. 6.
Figure 8:
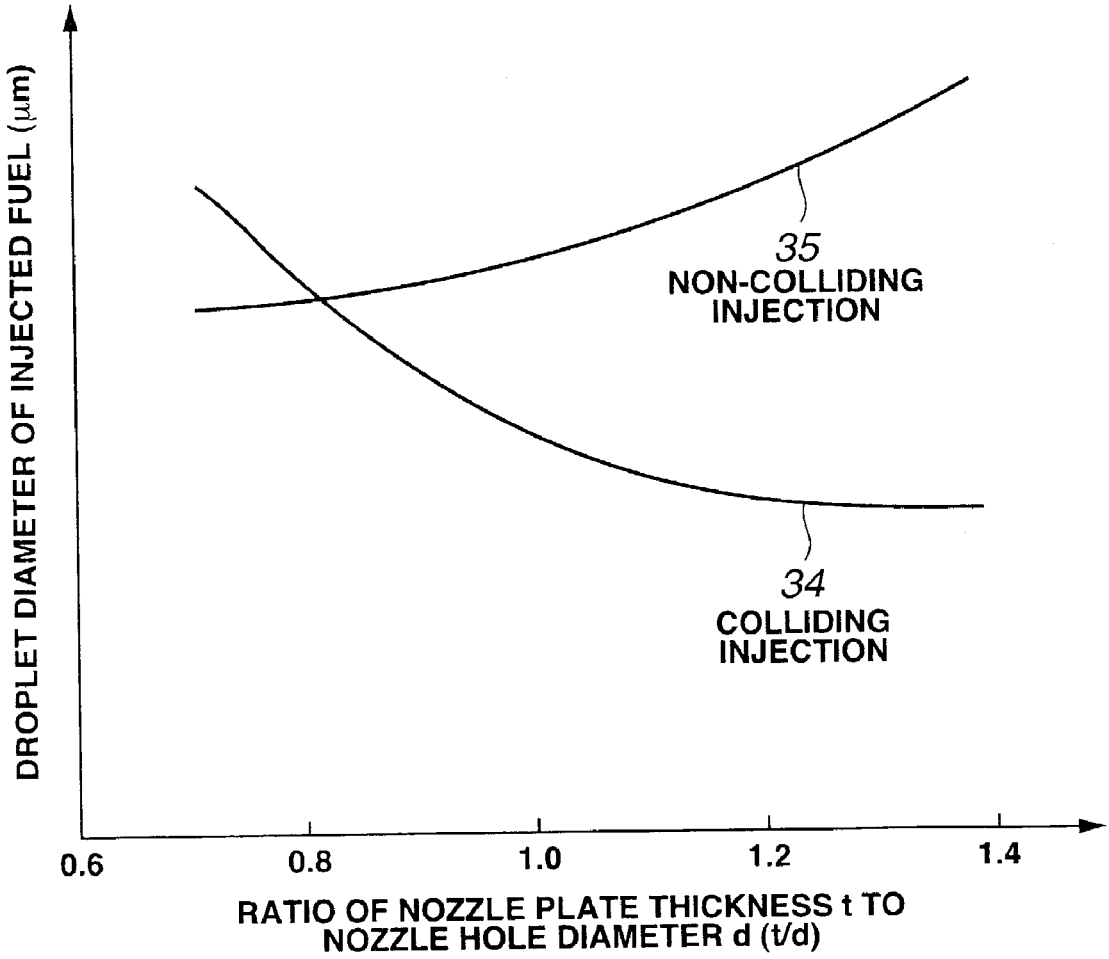
FIG. 8 is a graph showing a relationship between droplet diameter of injected fuel and dimensional ratio between nozzle plate thickness and nozzle hole diameter, characteristic of colliding and non-colliding nozzle plates.
Figure 9:
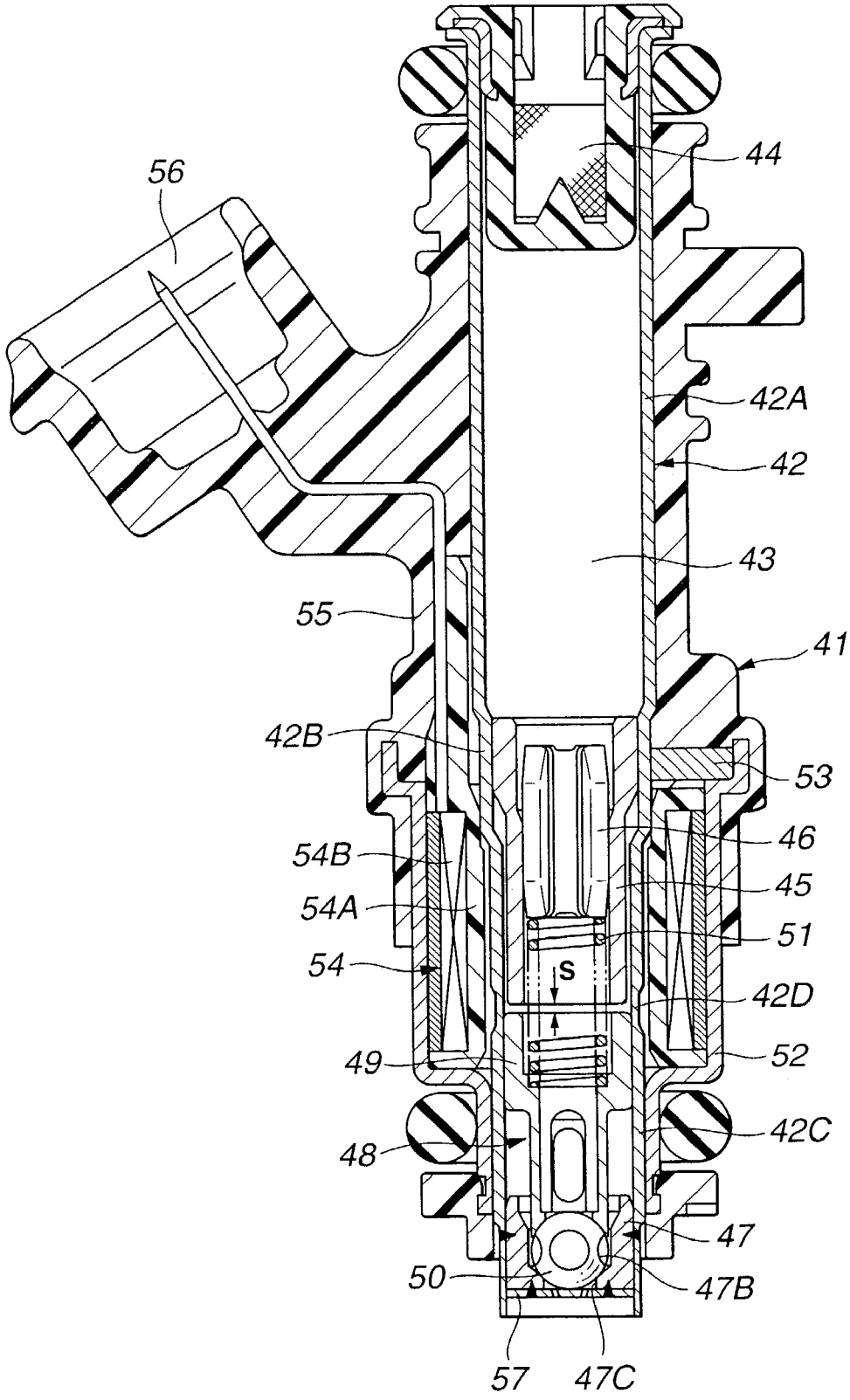
FIG. 9 is a cross-sectional view showing a fuel injection valve according to a second embodiment of the present invention.

Droplet diameter of fuel discharged from nozzle holes 21A and 21B of colliding nozzle plate 18 according to the first embodiment will be compared to that of a non-colliding nozzle plate with reference to FIGS. 7 and 8.

First, as shown in FIG. 7, non-colliding nozzle plate 18' has a plate thickness t equal to that of colliding nozzle plate 18 according to the first embodiment, and nozzle holes 21A' and 21B' formed therein have a hole diameter d equal to that of nozzle holes 21A and 21B according to the first embodiment. However, nozzle holes 21A' and 21B' are formed in nozzle plate 18' such that axes A—A and B—B of respective nozzle holes 21A' and 21B' form an upside-down V-shape. Nozzle holes 21A' and 21B' constitute a non-colliding nozzle-hole set to diffuse injection jets of fuel in differing directions without colliding them.

Droplet diameters of fuel discharged from nozzle holes 21A and 21B of nozzle plate 18 and that of fuel discharged from nozzle holes 21A' and 21B' of nozzle plate 18' are compared, assuming hole diameter d of nozzle holes 21A and 21B to be uniform with 21A' and 21B', where dimensional ratio t/d of plate thickness t and hole diameter d varies according to plate thickness t of nozzle plates 18 and 18'.

A result for fuel discharged from nozzle holes 21A and 21B of colliding nozzle plate 18 according to the first embodiment is shown in FIG. 8 by characteristic line 34, which represents a colliding injection. Here, droplet diameter becomes smaller the larger the dimensional ratio t/d becomes between plate thickness t and hole diameter d. In contrast, as shown by characteristic line 35 representing a non-colliding injection, droplet diameter of fuel discharged from nozzle holes 21A' and 21B' of non-colliding nozzle plate 18' becomes larger the greater dimensional ratio t/d becomes.

In the range where dimensional ratio t/d is approximately 0.8, the droplet diameter of fuel discharged from nozzle holes 21A and 21B of colliding nozzle plate 18 according to the first embodiment is substantially equal to that of non-colliding nozzle plate 18'. However, when dimensional proportion t/d is greater than or equal to 1.0, it is obvious that fuel is much more finely atomized when compared with that of non-colliding nozzle plate 18'.

In this way, plate thickness t of nozzle plate 18 and hole diameter d of nozzle holes 21A and 21B according to the first embodiment are in a dimensional ratio t/d where the expression $t/d \geqq 1.0$ is satisfied.

Thus, it is possible to make length L of nozzle holes 21A and 21B formed in nozzle plate 18 larger, and to maintain the ability of injection jets to travel in a straight line when fuel is discharged from each nozzle hole 21A, 21B in the directions designated by F.

It then becomes possible to properly collide injection jets discharged from nozzle holes 21A and 21B of each nozzle-hole set 22 through 27, and to promote atomization of fuel. Accordingly, fuel discharged from each nozzle-hole set 22 through 27 can be properly intermixed by broadening spray patterns 28 through 33 into a wider area, and more efficient combustion of fuel within an engine combustion chamber is possible.

In the first embodiment plate thickness t of nozzle plate 18 (flat portion 18A) is set within a range $0.3\ \text{mm} \geqq t \geqq 0.05\ \text{mm}$, and hole diameter d of each nozzle hole 21A, 21B is set within a range $0.3\ \text{mm} \geqq t \geqq 0.05\ \text{mm}$.

Therefore it is possible to form nozzle holes 21A and 21B in nozzle plate 18 using a common hole-forming tool such as a drill, and it is possible to contribute to a reduction in production cost for nozzle plate 18.

A second embodiment according to the present invention will now be explained referring to FIGS. 9 through 12. A feature of the second embodiment rests in being applied to a fuel injection valve whose casing is a magnetic cylinder.

A casing 41 is designed as an outer case of a fuel injection valve, and includes a magnetic cylinder 42, a yoke 52, and a resin cover 55. In this instance, what was valve casing 2, fuel inlet pipe 3, and joining member 4 in the first embodiment are integrally formed as magnetic cylinder 42.

Magnetic cylinder 42 constitutes a main portion of casing 41, and is a thin metal pipe formed with steps through such processing as deep drawing of magnetic stainless steel or a similar material.

A base of magnetic cylinder 42 is formed with a larger diameter as a large diameter portion 42A, an intermediary section extending axially therefrom forms a mid-diameter portion 42B with a smaller diameter than large diameter portion 42A, and an end extending further axially therefrom forms a small diameter portion 42C with a smaller diameter than mid-diameter portion 42B. The base of large diameter portion 42A of magnetic cylinder 42 is joined to an engine fuel conduit (not shown) or similar fuel supply.

A magnetic reluctance portion 42D is formed at a position axially midway of small diameter portion 42C, the position coinciding with a space S existing between a core tube 45 and an anchor portion 49 of a valve element 48. Therefore, both sections of small diameter portion 42C axially on either side of magnetic reluctance portion 42D are substantially cut off magnetically by the provision of magnetic reluctance portion 42D.

A fuel passage 43 is disposed within magnetic cylinder 42, and the base of large diameter portion 42A forms a fuel inlet opening thereof. Fuel passage 43 extends axially from the fuel inlet opening as far as a valve seat member 47. A fuel filter 44 is disposed at the base end of large diameter portion 42A to filtrate fuel flowing into fuel passage 43 from a fuel conduit.

Core tube 45 is inserted within magnetic cylinder 42, and forms part of a closed magnetic circuit generated by an electromagnetic coil 54. Core tube 45 also serves to regulate how far valve element 48 may open. Core tube 45 is installed within mid-diameter portion 42B of magnetic cylinder 42 through press fitting, and an end surface thereof faces an end surface of anchor portion 49 of valve element 48. Space S exists between core tube 45 and anchor portion 49.

A spring bearing 46 is disposed within core tube 45 through press fitting, and is formed in a thin tubular shape. A valve spring 51 is retained between spring bearing 46 and valve element 48, and since spring bearing 46 is press-fitted within core tube 45, it is possible to adjust a spring force of valve spring 51 according to how deeply spring bearing 46 is press-fitted with respect to core tube 45.

Valve seat member 47 is disposed within small diameter portion 42C of magnetic cylinder 42 on a side of valve element 48 opposite core tube 45. As can be seen from FIG. 10, valve seat member 47 is formed as a cylindrical shaft defining a valve element insertion hole 47A. A valve seat 47B is disposed on an inner circumference of valve seat member 47, and defines an injection opening 47C in substantially the same manner as the first embodiment. Valve seat member 47 is press-fitted within small diameter portion 42C of magnetic cylinder 42, and is welded about an entire outer circumference thereof to small diameter portion 42C. A nozzle plate 57 is welded to an end surface of valve seat member 47 to cover injection opening 47C.

Valve element 48 is contained within small diameter portion 42C of magnetic cylinder 42, between core tube 45 and valve seat member 47, and is axially displaceable therein. Valve element 48 comprises anchor portion 49 which is formed in a stepped tube shape and made from a magnetic metallic material, and a valve portion 50 which is spherical and fixed to an end portion of anchor portion 49. Valve portion 50 rests on or lifts from valve seat 47B of valve seat member 47.

Valve portion 50 of valve element 48 is normally held in a resting state on valve seat 47B of valve seat member 47, and in this state space S is formed axially between the end surface of anchor portion 49 and the end surface of core tube 45. When electrical power is fed to electromagnetic coil 54, anchor portion 49 is magnetically attracted to core tube 45, whereby valve element 48 opens as a result of valve portion 50 lifting from valve seat 47B of valve seat member 47 against the spring force of valve spring 51.

Valve spring 51 is disposed between spring bearing 46 and valve element 48, and normally applies force to valve element 48 in a closed-valve direction (direction in which valve portion 50 rests on valve seat 47B of valve seat member 47). The spring force of valve spring 51 can be adjusted according to how deeply spring bearing 46 is press-fitted with respect to core tube 45.

Yoke 52 is disposed on an outer circumference of magnetic cylinder 42, is formed in a stepped tube shape and made from a magnetic metallic material, and constitutes a portion of casing 41. Yoke 52 is fixedly press-fitted to an outer circumference of small diameter portion 42C of magnetic cylinder 42. A connecting core 53 is disposed between mid-diameter portion 42B of magnetic cylinder 42 and yoke 52, and is formed from a magnetic material substantially in a C-shape around the outer circumference of mid-diameter portion 42B.

Electromagnetic coil 54 is disposed between magnetic cylinder 42 and yoke 52 as an actuator, and is mainly comprised of a coil form 54A formed from resin material in a tube-shape, and a coil 54B wound about coil form 54A. An inner circumference of coil form 54A is attached to mid-diameter portion 42B of magnetic cylinder 42.

When electromagnetic coil 54 is electrically energized, small diameter portion 42C of magnetic cylinder 42, core tube 45, anchor portion 49 of valve element 48, yoke 52, and connecting core 53 form a closed magnetic circuit. Anchor portion 49 of valve element 48 is magnetically attracted by core tube 45 due to the closed magnetic circuit passing through space S existing between core tube 45 and anchor portion 49 of valve element 48.

Resin cover 55 is disposed on the outer circumference of magnetic cylinder 42, and in a state where elements including yoke 52, connecting core 53, and electromagnetic coil 54 are assembled on the outer circumference of magnetic cylinder 42, a connector 56 is formed integrally therewith on an outer surface thereof using a means such as injection molding.

Therefore when electromagnetic coil 54 is electrically energized via connector 56, valve element 48 opens, and fuel supplied to fuel passage 43 within magnetic cylinder 42 is injected into an engine intake manifold through injection opening 47C of valve seat member 47, and then through nozzle plate 57.

Figure 10:
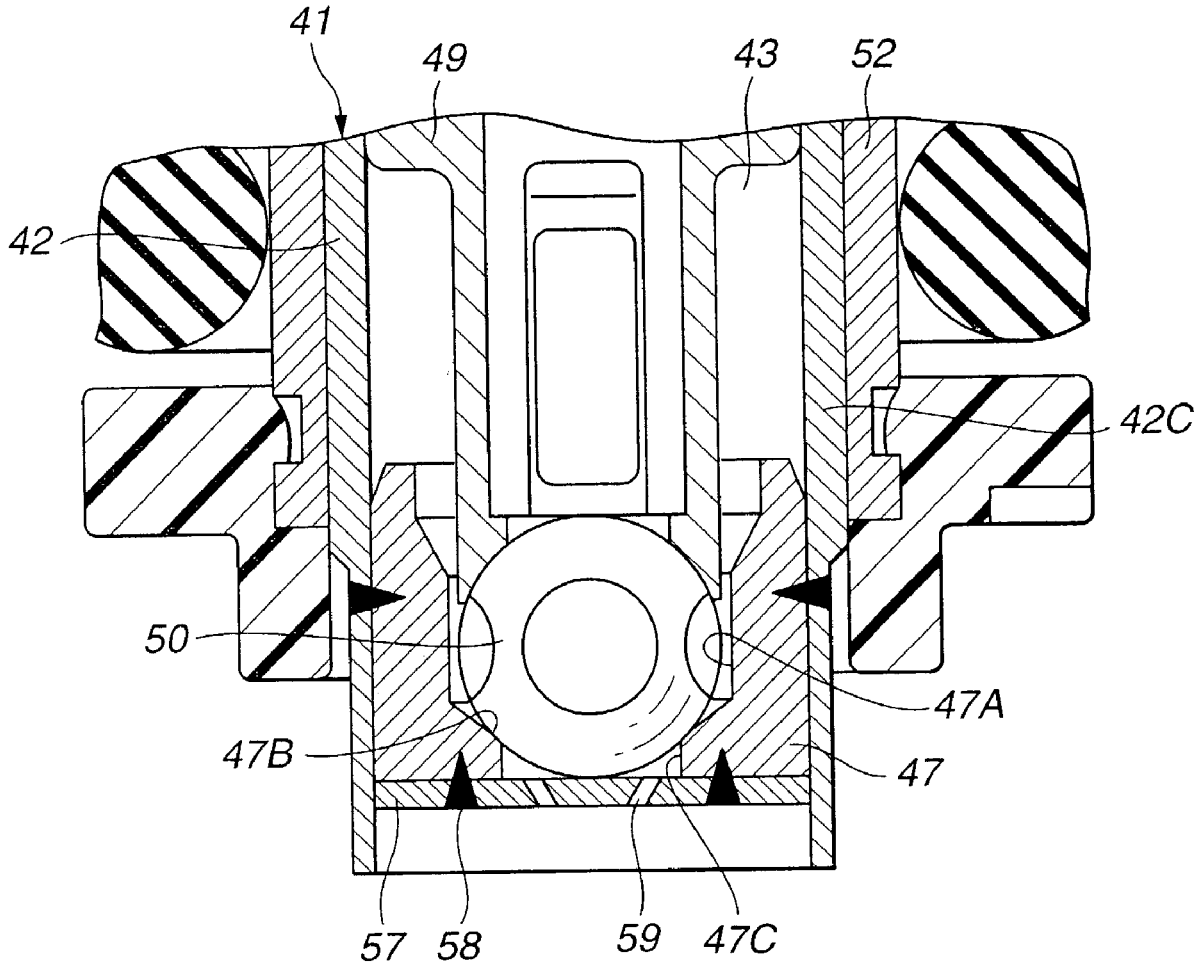
FIG. 10 is an enlarged cross-sectional view showing an end of an electromagnetic tubular body found in FIG. 9.
Figure 11:
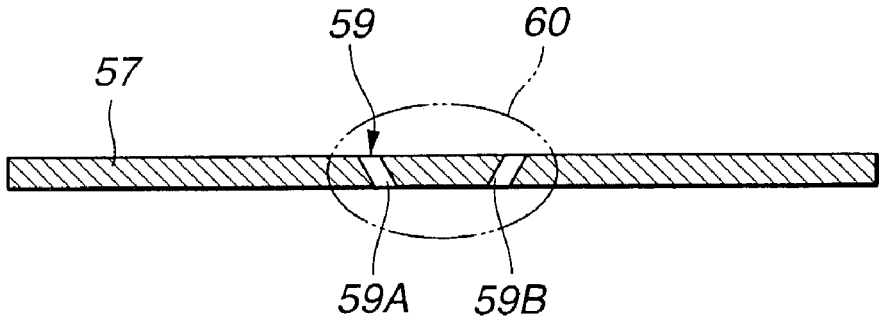
FIG. 11 is a cross-sectional view showing only the nozzle plate in FIG. 10.
Figure 12:
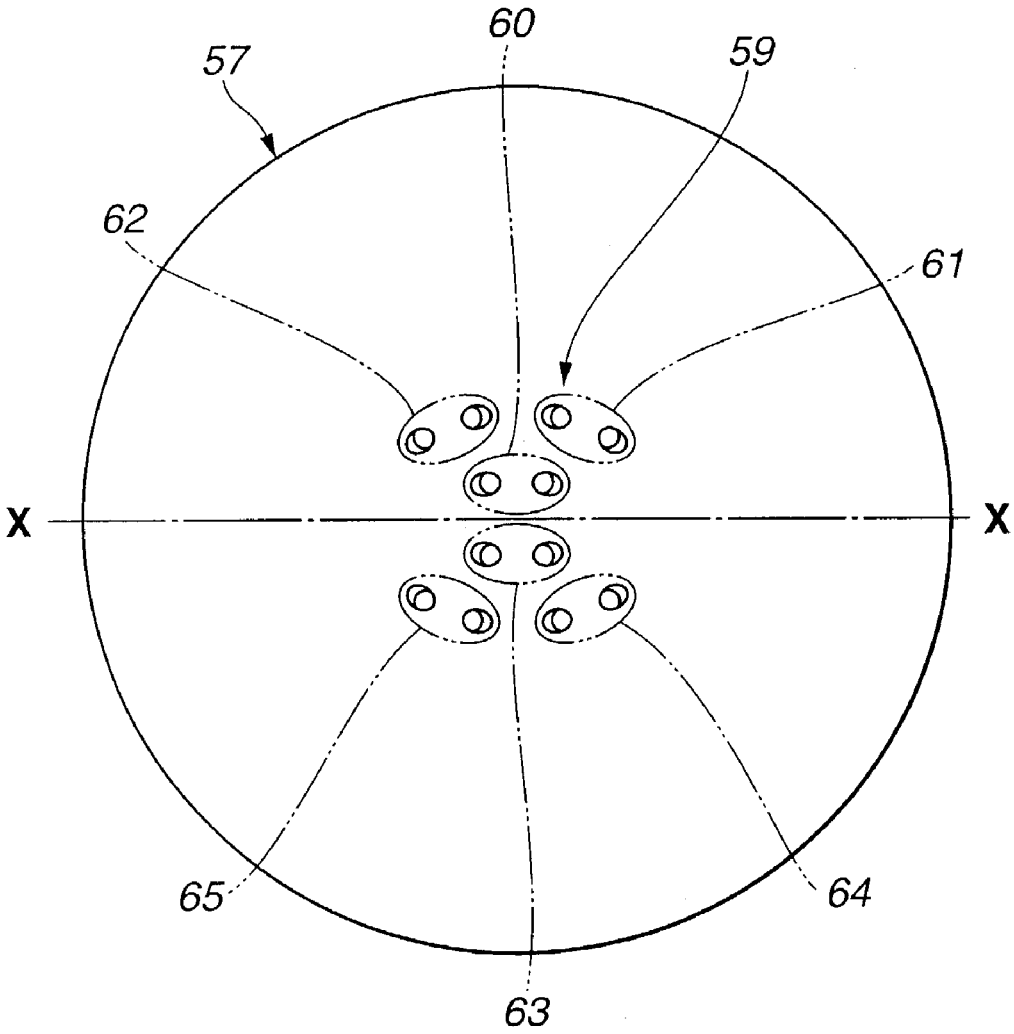
FIG. 12 is a plan view showing only the nozzle plate.

As shown in FIGS. 10 through 12, nozzle plate 57 covers injection opening 47C of valve seat member 47 on an outer side thereof. Nozzle plate 57 is formed from a material such as circular metal plate with a predetermined thickness, and is joined to the end surface of valve seat member 47 by means of welding portion 58 in a manner substantially the same as the first embodiment.

A plurality of nozzle holes 59 is disposed centrally in nozzle plate 57. Two adjacent holes 59A and 59B constitute a hole set, there being six nozzle-hole sets 60, 61, 62, 63, 64, and 65 in a manner substantially the same as the first embodiment. The hole diameter, angle of inclination, displacement, and other attributes of nozzle holes 60 through 65 are set in substantially the same manner as the first embodiment, and such that the aforementioned formula and conditions are satisfied.

Nozzle plate 57 is formed as a colliding nozzle plate, and injection jets of fuel discharged from respective nozzle holes 59A and 59B of nozzle-hole sets 60 through 65 are collided with one another.

In this manner, it is possible to achieve results with the present second embodiment which are substantially the same as those of the first embodiment, and furthermore, it is possible to apply colliding nozzle plate 57 to a fuel injection valve comprising magnetic cylinder 42.

This application is based on prior Japanese Patent Applications Nos. 2003-023128 and 2002-157919. The entire contents of Japanese Patent Application No. 2003-023128 with a filing date of Jan. 31, 2003, and Japanese Patent Application No. 2002-157919 with a filing date of May 30, 2002, are hereby incorporated by reference.

Although the invention has been described above by reference to certain embodiments of the invention, the invention is not limited to the embodiments described above. Modifications and variations of the embodiments described above will occur to those skilled in the art in light of the above teachings. The scope of the invention is defined with reference to the following claims.

For example, from two to five sets, or seven or more sets of nozzle holes may be formed. Also, a nozzle-hole set may comprise as many as three or perhaps four holes.

What is claimed is:

1. A fuel injection valve comprising:

a casing comprising a fuel passage;

a valve seat member disposed in the casing, the valve seat member comprising a valve seat;

a valve element displaceably disposed within the casing, being in one of a rested state or a lifted state relative to the valve seat; and a substantially flat nozzle plate covering the valve seat, the nozzle plate comprising a plurality of nozzle-hole sets, each of which comprises a plurality of nozzle holes, each nozzle-hole set injecting fuel injection jets and colliding the fuel injection jets with each other when the valve element is lifted from the valve seat, the nozzle-hole sets constituting two nozzle-hole-set aggregations, the two aggregation being arranged to direct the collided fuel injection jets to two different directions, a thickness of the substantially flat nozzle plate being equal to or greater than a diameter of the nozzle holes.

2. The fuel injection valve as claimed in claim 1, wherein the thickness of the nozzle plate and the diameter of the nozzle holes are predetermined, a ratio of the thickness of the nozzle plate to the diameter of the nozzle holes being equal to or greater than a value of 1.0.

3. The fuel injection valve as claimed in claim 2, wherein the thickness of the nozzle plate and the diameter of the nozzle holes are respectively less than or equal to a first value and greater than or equal to a second value.

4. The fuel injection valve as claimed in claim 3, wherein the first value is 0.33 mm and the second value is 0.05 mm.

5. The fuel injection valve as claimed in claim 1, wherein the nozzle plate comprises six nozzle-hole sets.

6. The fuel injection valve as claimed in claim 5, wherein each nozzle-hole set comprises two nozzle holes.

7. The fuel injection valve as claimed in claim 1, wherein the nozzle plate comprises at least two nozzle-hole sets, each nozzle-hole set comprising from two to four nozzle holes.

8. The fuel injection valve as claimed in claim 7, wherein the valve element is at least partially formed from a magnetic material, and the casing comprises electromagnetic means for displacing the valve element to lift the valve element from the valve seat.

9. The fuel injection valve as claimed in claim 8, wherein the electromagnetic means comprises a plurality of elements which in combination form a closed magnetic circuit when electrically energized for displacing the valve element.

10. The fuel injection valve as claimed in claim 9, wherein the plurality of elements comprises a fuel inlet pipe, a magnetic-path forming member in contact with the fuel inlet pipe, and a valve casing in contact with the magnetic-path forming member, the valve casing being in contact with and housing the valve element, the valve element being attracted to the fuel inlet pipe when the plurality of elements is electrically energized.

11. The fuel injection valve as claimed in claim 9, wherein the plurality of elements comprises a magnetic shaft, the magnetic shaft comprising two magnetically separated halves, the two magnetically separated halves being axially separated by a magnetic reluctance portion, a connecting core in contact with the magnetic shaft at a magnetically separated half thereof, and a yoke in contact with the connecting core and with the magnetic shaft at another magnetically separated half thereof the magnetic shaft housing the valve element and a core tube for attracting the valve element, a space existing between the valve element and the core tube, the magnetic reluctance portion being formed at a position coinciding with the space, the valve element being attracted to the core tube when the plurality of elements is electrically energized.

12. A fuel injection valve connected to an internal combustion engine, the fuel injection valve comprising:

a casing comprising a fuel passage;

a valve seat member disposed in the casing, the valve seat member comprising a valve seat;

a valve element displaceably disposed within the casing; and a substantially flat nozzle plate covering the valve seat, the nozzle pate plate comprising six nozzle-hole sets, each nozzle-hole set comprising two nozzle holes, each nozzle-hole set injecting two fuel injection jets and colliding the two fuel injection jets with each other when the valve element is lifted from the valve seat, the nozzle-hole sets constituting two nozzle-hole-set aggregations, the nozzle-hole-set aggregations being arranged to direct the collided fuel injection jets to two different directions, a ratio between the thickness of the nozzle plate and the diameter of the nozzle holes being equal to or greater than a value of 1.0.

13. The fuel injection valve as claimed in claim 12, wherein a first and second nozzle hole of each nozzle-hole set are inclined symmetrically with respect to the Y—Y axis at a predetermined angle, a first axis A—A and a second axis B—B of the respective first and second nozzle holes intersecting on the Y—Y axis at a point which is within the engine.

14. The fuel injection valve as claimed in claim 13, wherein the nozzle-hole-set aggregations are symmetric with respect to the X—X axis.

15. A fuel injection valve, comprising:

a casing defining a fuel passage;

a valve seat member disposed in the casing, the valve seat member defining a valve seat;

a valve element displaceably disposed in the casing; and a substantially flat nozzle plate covering the valve seat, the nozzle plate comprising a plurality of nozzle-hole-set aggregations which are symmetrically arranged with respect to a center line of the nozzle plate, each of the nozzle-hole-set aggregations comprising a plurality of nozzle-hole sets, each of the nozzle-hole sets comprising a plurality of nozzle holes, each nozzle-hole set injecting fuel injection jets and colliding the fuel injection jets with each other when the valve element is displaced so as to form a clearance between the valve element and the valve seat, each nozzle-hole set forming a spray pattern in the direction away from the center line of the nozzle plate, a thickness t of the nozzle plate and a diameter d of the nozzle holes existing in a ratio where the equation $t/d \geqq 1.0$ is satisfied.

16. The fuel injection valve as claimed in claim 15, wherein the nozzle plate comprises two nozzle-hole-set aggregations, each nozzle-hole-set aggregation comprising at least two nozzle-hole sets, each nozzle-hole set comprising from two to four nozzle holes.

* * * * *